US008185016B2

(12) United States Patent
Mori et al.

(10) Patent No.: US 8,185,016 B2
(45) Date of Patent: May 22, 2012

(54) IMAGE FORMING APPARATUS

(75) Inventors: Hirotaka Mori, Nagoya (JP); Atsushi Miwa, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 66 days.

(21) Appl. No.: 12/646,401

(22) Filed: Dec. 23, 2009

(65) Prior Publication Data

US 2010/0166455 A1 Jul. 1, 2010

(30) Foreign Application Priority Data

Dec. 26, 2008 (JP) ..... 2008-332619
May 29, 2009 (JP) ..... 2009-130049

(51) Int. Cl.
*G03G 21/00* (2006.01)

(52) U.S. Cl. ..... 399/124; 399/303; 399/393

(58) Field of Classification Search ..... 399/107, 399/110, 124, 299, 300, 302, 303, 306, 308, 399/388, 393
See application file for complete search history.

(56) References Cited

U.S. PATENT DOCUMENTS 6,522,848 B2 * 2/2003 Wakana ..... 399/121
7,454,158 B2 11/2008 Nakano et al.
7,526,227 B2 4/2009 Sato et al.
7,862,030 B2 1/2011 Igarashi
2003/0147678 A1 8/2003 Ozawa et al.
2006/0079358 A1 * 4/2006 Igarashi ..... 474/87
2006/0140669 A1 * 6/2006 Sato ..... 399/110
2007/0048005 A1 * 3/2007 Nakano et al. ..... 399/110
2008/0292355 A1 * 11/2008 Sakurai et al. ..... 399/110
2009/0092429 A1 4/2009 Yokota

FOREIGN PATENT DOCUMENTS

CN 1755534 A 4/2006
CN 1920681 A 2/2007
JP H04-371422 A 12/1992
JP H06-016253 A 1/1994

(Continued)

OTHER PUBLICATIONS

Japan Patent Office, Notification of Reason for Refusal for Patent Application No. JP 2008-332619, mailed Dec. 22, 2010.

(Continued)

*Primary Examiner* — David Porta
*Assistant Examiner* — Benjamin Schmitt
(74) *Attorney, Agent, or Firm* — Baker Botts L.L.P.

(57) ABSTRACT

An image forming apparatus includes: a main body; an image forming unit including a plurality of photosensitive drums on which electrostatic latent images are formed, respectively; a sheet storing unit detachably attached to the main body and configured to store a recording sheet, and the sheet storing unit being disposed in a first space defined in the main body when the sheet storing unit is attached to the main body; and a belt unit disposed between the plurality of photosensitive drums and the sheet storing unit and including a belt opposing the plurality of photosensitive drums. The belt unit is detachable from the main body through the first space in a state in which at least a part of the sheet storing unit is positioned outside the main body.

20 Claims, 12 Drawing Sheets

FOREIGN PATENT DOCUMENTS

| | | | |
|---|---|---|---|
| JP | 2000-235309 | A | 8/2000 |
| JP | 2000-275987 | A | 10/2000 |
| JP | 2002-108172 | A | 4/2002 |
| JP | 2003-195649 | A | 7/2003 |
| JP | 2004-325904 | A | 11/2004 |
| JP | 2006-184554 | A | 7/2006 |
| JP | 2007-057953 | A | 3/2007 |
| JP | 2009-092858 | A | 4/2009 |

OTHER PUBLICATIONS

Japan Patent Office; Notification of Reason for Refusal for Patent Application No. 2008-332619, dated Oct. 5, 2010.

The State Intellectual Property Office of the People's Republic of China, The First Office Action for Chinese Patent Application No. 200910215406.0, mailed Aug. 30, 2011.

* cited by examiner

IMAGE FORMING APPARATUS

CROSS-REFERENCE TO RELATED APPLICATIONS

This application claims priority from Japanese Patent Application No. 2008-332619 filed on Dec. 26, 2008 and Japanese Patent Application No. 2009-130049 filed on May 29, 2009, the entire contents of which are incorporated herein by reference.

TECHNICAL FIELD

The present invention relates to an image forming apparatus including a belt unit opposing an image forming unit.

BACKGROUND

An known image forming apparatus includes process cartridges (image forming unit) each of which includes a photosensitive drum, a belt unit which is disposed below and opposes the photosensitive drums and includes a belt for conveying a sheet between the belt and the photosensitive drums, and a drawer which holds the process cartridges integrally and can be drawn out from a main body. In this technique, when a maintenance of the belt unit or the periphery thereof (e.g., exchange, cleaning, and fixing paper jam) is performed, the drawer is detached from the main body, and thereafter the belt unit is detached from the main body through a space in the main body made by detaching the drawer.

Each of the process cartridges is connected to a drive source of the main body, e.g., via a coupling, so as to transmit driving force from the drive source to components of each of the process cartridge (e.g., a photosensitive drum). Therefore, when the maintenance is performed, the user or worker conducts a work to cut the connection between the driving source of the main body and the process cartridges and thereafter to pull out the drawer.

SUMMARY

In the above-described technique, it is necessary to cut the connection between the process cartridges and the drive source of the main body, which requires time and labor and may make the maintenance troublesome. Further, there is a need for keeping the number of detachment/attachment of the process cartridges required for forming an image formation as small as possible.

The present invention was made in view of at least one of the above-circumstances, and an object thereof is to provide an image forming apparatus capable of facilitating maintenance works of the belt unit.

According to an aspect of the invention, there is provided an image forming apparatus comprising: a main body; an image forming unit comprising a plurality of photosensitive drums on which electrostatic latent images are formed, respectively; a sheet storing unit detachably attached to the main body and configured to store a recording sheet, and the sheet storing unit being disposed in a first space defined in the main body when the sheet storing unit is attached to the main body; and a belt unit disposed between the plurality of photosensitive drums and the sheet storing unit and comprising a belt opposing the plurality of photosensitive drums, wherein the belt unit is detachable from the main body through the first space in a state in which at least a part of the sheet storing unit is positioned outside the main body.

BRIEF DESCRIPTION OF DRAWINGS

FIGS. 11A and 11B shows a color printer of an intermediate transfer system applied to the image forming apparatus according to the second exemplary embodiment, in which FIG. 11A is a diagram showing the components provided inside the color printer, and FIG. 11B is a diagram showing a state in which the sheet feed tray is pulled out from the main body.

DESCRIPTION

Figure 1:
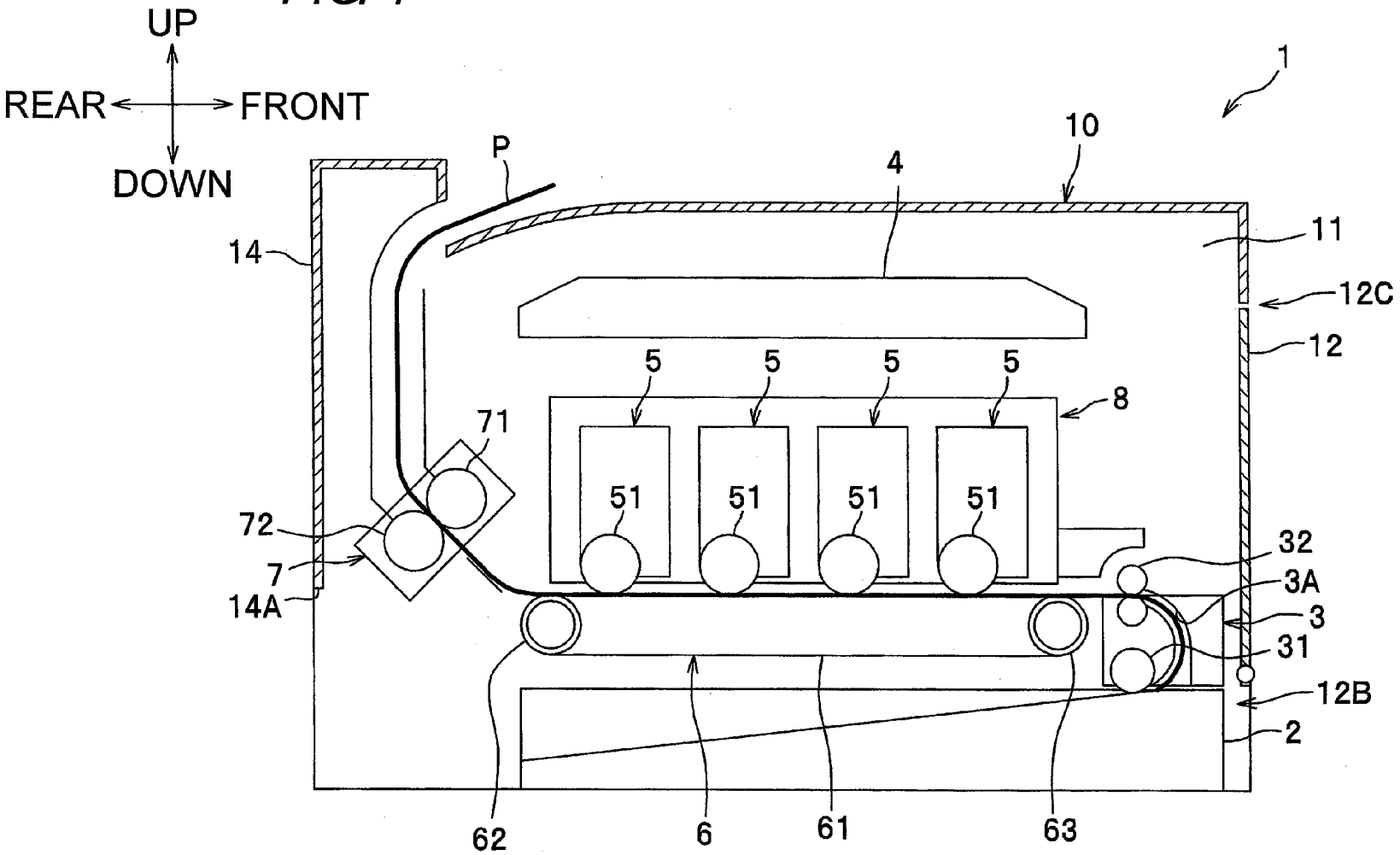
FIG. 1 is a diagram showing an entire configuration of a color printer as an example of an image forming apparatus according to a first exemplary embodiment.

Next, exemplary embodiments of the present invention are described in detail with reference to the drawings.

In the following description, directions are defined as viewed from a user who operates the color printer. That is, in FIGS. 1 and 6, the right side of the drawing sheet is defined as "front side (near side)", the left side of the drawing sheet is defined as "rear side (far side)", the far side in a direction perpendicular to the drawing sheet is defined as "right side", and the near side in the direction perpendicular to the drawing sheet is defined as the "left side". Further, the vertical direction in the drawing sheet is defined as "up-down direction".

(First Exemplary Embodiment)

As shown in FIG. 1, a color printer 1 includes: a sheet feed tray 2 as an example of a sheet storing unit; a sheet feed unit 3 as an example of a supply unit; a scanner unit 4; a plurality of process cartridges 5 as an example of an image forming unit; a belt unit 6; and a fixing device 7, which are stored in a box-shaped main body 10.

The scanner unit 4, the process cartridges 5, the belt unit 6 and the sheet feed tray 2 are arranged in this order from an upper side to a lower side. The sheet feed unit 3 is disposed on a front side of the belt unit 6 and above an front end portion of the sheet feed tray 2. The fixing device 7 is disposed on a rear side of the belt unit 6. On a front surface of the main body 10 corresponding to a front side of the process cartridges 5 and the front side of the sheet feed tray 2, an opening portion 12C and a pull-out port 12B are provided. The process cartridges 5 can be attached and detached through the opening portion 12C. The sheet feed tray 2 can be attached and detached through the pull-out port 12B. A front cover 12 is provided so as to open and close the opening portion 12C.

The sheet feed tray 2 is a tray configured to store a sheet P as an example of a recording sheet. The sheet feed tray 2 is movable (slidable) in a front-rear direction and can be attached to and detachable from the main body 10 through the front side thereof.

The sheet feed unit 3 is a device configured to supply the recording sheet P stored in the sheet feed tray 2 to the belt unit 6. The sheet feed unit 3 includes: a feed roller 31 contacting the recording sheet P stored in the sheet feed tray 2; a conveying roller 32 disposed on a substantially same plane to that of an upper surface of a conveying belt 61 of the belt unit 6; and a guide path 3A for guiding the sheet P from the feed roller 31 to the conveying roller 32. The sheet feed unit 3 is fixed to a pair of side frames 11 defining right and left side walls of the main body 10 by known fastening means. The sheet feed unit 3 is disposed overlapped with the belt unit 6 as viewed from the front-rear direction (a direction in which the sheet P is conveyed by the conveying belt 61), specifically, is disposed on a front side of the belt unit 6. Therefore, the sheet feed unit 3 reinforces the side frames 11. The conveying roller 32 may function as a registration roller as an example of a leading-end controlling member configured to control a position of a leading end of the recording sheet P.

The scanner unit 4 includes a known configuration, for example, a laser beam generation unit, a polygon mirror, a lens, and a reflecting mirror which are not shown. The scanner unit 4 irradiates the laser beams on each of surfaces of photosensitive drums 51 of the process cartridges 5 by fast scanning.

Each of the process cartridges 5 includes the photosensitive drum 51 on which an electrostatic latent image is formed. In addition, the process cartridge 5 further includes a charger, a toner accommodating chamber, a supply roller and a developing roller. The process cartridges 5 are aligned in the front-rear direction and integrally supported to a drawer 8 as an example of a holding member. The drawer 8 is supported on guide rails provided on the respective side frames 11 so as to be movable in the front-rear direction. Accordingly, the drawer 8 can be pulled out to the outside of the main body 10 through the opening portion 12C that is formed by opening the front cover 12 provided on the front side of the main body 10. A part of the drawer 8 is supported and engaged with the main body 10 when the drawer 8 is pulled out. In other words, the drawer 8 is not completely detached from the main body 10, i.e., can not be separated from the main body 10. The drawer 8 and the belt unit 6 are movable in the front-rear direction, but they are held at respective image forming operation positions in the main body 10.

In the process cartridge 5, the photosensitive drum 51 is charged by the charger and then exposed by the laser beam emitted from the scanner unit 4. Accordingly, the electrostatic latent image is formed on the surface of the photosensitive drum 51. Thereafter, toner (developing agent) accommodated in the toner accommodating chamber is supplied to the electrostatic latent image formed on the photosensitive drum 51 by the supply roller, etc. Accordingly, a toner image (developing agent image) is carried on the photosensitive drum 51.

The belt unit 6 includes: the conveying belt 61 of an endless belt which oppose the photosensitive drums 51; a drive roller 62 and a driven roller 63 configured to allow the conveying belt 61 to stretch therebetween and rotate; and a frame (not shown) that rotatably supports the rollers 62 and 63. The belt unit 6 is disposed between the photosensitive drums 51 and the sheet feed tray 2, specifically, disposed above and adjacent to the sheet feed tray 2.

The belt unit 6 is attachable to/detachable from the main body 10 through a space A (see FIG. 2) and a rear opening portion 14A. The space A is formed by detaching the sheet feed tray 2 and defined in the main body 10. The rear opening portion 14A is provided in a rear surface of the main body 10. The detail of a mechanism for attaching/detaching the belt unit 6 will be described later.

As used herein, the language "the sheet feed tray 2 is detached" may contain "the sheet feed tray 2 is completely separated from the main body 10", and also may contain "a part of the sheet feed tray 2 is engaged with the main body 10 and a part (e.g., substantially entire part) of the sheet feed tray 2 is exposed from the main body 10 to the outside thereof.

The belt unit 6 allows the recording sheet P to be conveyed between the conveying belt 61 and the photosensitive drums 51. During the conveyance of the recording sheet P, the toner images of photosensitive drums 51 are transferred to the recording sheet P by a plurality of transfer rollers (not shown) provided in a region enclosed by the conveying belt 61.

The fixing device 7 is a device for thermally fixing the toner image transferred to the recording sheet P. The fixing device 7 includes a heat roller 71 and a pressure roller 72. The fixing device 7 is disposed overlapped with the belt unit as viewed from the front-rear direction, specifically, is provided on a rear side of the belt unit 6. The recording sheet P which has been thermally fixed by the fixing device 7 is discharged to the outside of the main body by a conveying roller (not shown).

<Mechanism for Attaching/Detaching Belt Unit>

Next, the mechanism for attaching/detaching the belt unit 6 is described in detail.

Figure 2:
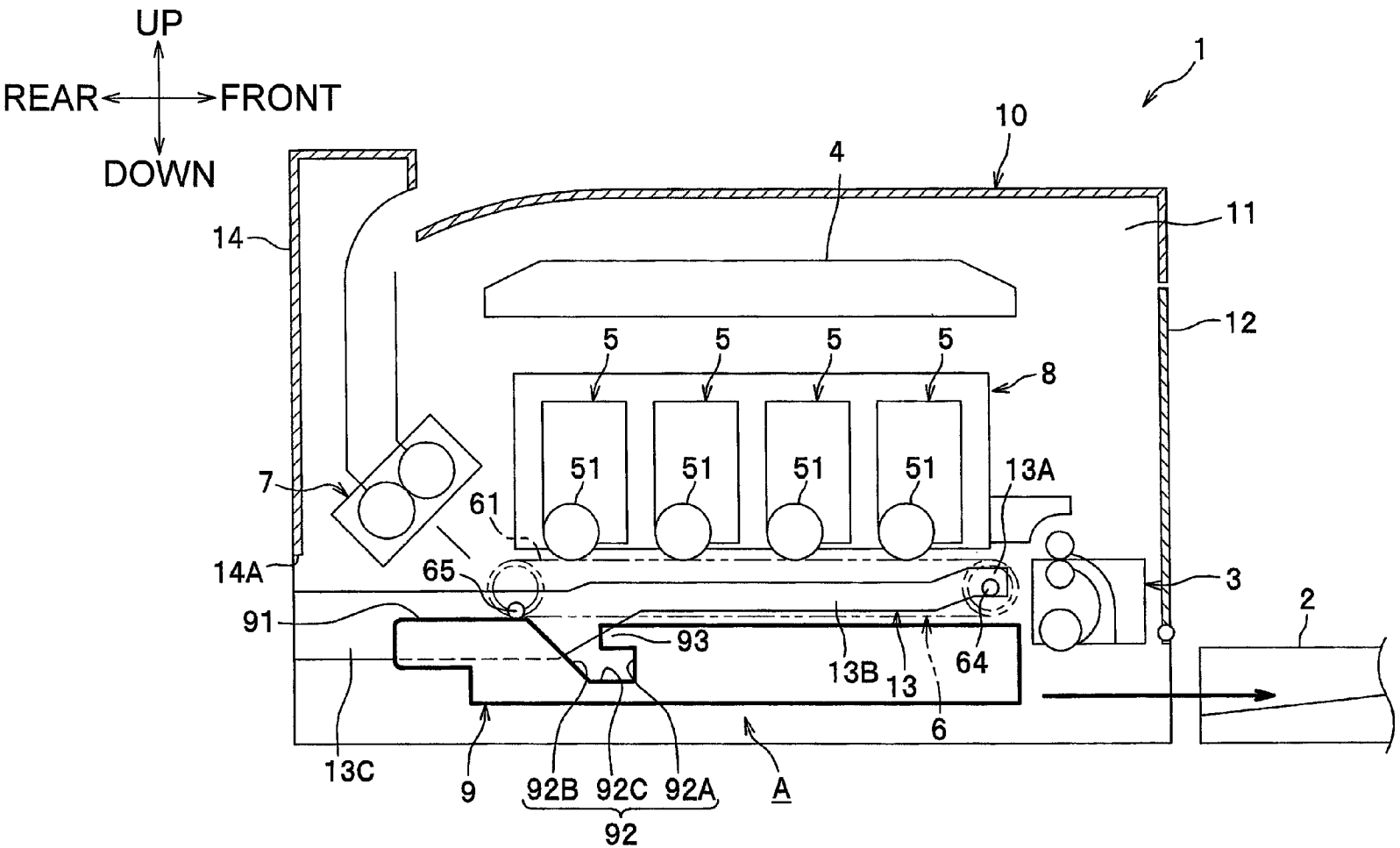
FIG. 2 is a diagram showing a mechanism for attaching/detaching a belt unit in the first exemplary embodiment.

As shown in FIG. 2, the frame (not shown) of the belt unit 6 includes front protrusions 64 and rear protrusions 65. The front protrusions 64 are spaced from the rear protrusions 65 in the front-rear direction. The front protrusions 64 and the rear protrusions 65 are formed on right and left side surfaces of the belt unit 6 so as to protrude toward outside in a right-left direction. The front protrusions 64 are preferably disposed at a position identical with or on a front side of a rotation center of the drive roller 63 (see FIG. 1).

Each of the right and left frames 11 of the main body 10 has a groove-shaped guide rail 13 which supports the front protrusion 64 of the belt unit 6 and guides the belt unit 6 to the outside of the main body 10 while the belt unit 6 is separated from the photosensitive drums 51. Specifically, the guide rail 13 includes a first groove 13A, a second groove 13B, and a third groove 13C and reaches the rear opening portion 14A. The first groove 13 supports the front protrusion 64 when the belt unit 6 is positioned at an attached position (the position shown in FIG. 2) for the image formation operation. The second groove 13B is formed at an obliquely rear lower position of the first groove 13A. The third groove 13C is formed at an obliquely rear lower position of the second groove 13B.

The first groove 13A, the second groove 13B and the third groove 13C extend substantially along the front-rear direction, and are continuously connected via connection grooves (reference numerals thereof are omitted) which obliquely extend. The third groove 13C has formed wider than the first groove 13A and the second groove 13B. Consequently, when the belt unit 6 is attached, the front protrusion 64 can easily be inserted in the third groove 13C.

Each of the rear protrusions 65 of the belt unit 6 is disposed inside of the main body 10 than the guide rail 13 in the right-left direction so as not to enter the guide rail 13. Therefore, when the belt unit 6 is positioned at the attached position, the belt unit 6 is not supported by the guide rails 13 but supported by a support member 9 from below. That is, the rear protrusions 65 and the front protrusions 64 are supported the support member 9 and the first grooves 13A, respectively, which can position the belt unit 6 in the up-down direction. In this exemplary embodiment, the positioning of the belt unit 6 in the front-rear direction can be made by the front protrusions 64 located to contact a part of the main body 10 from a rear side.

The support member 9 is disposed adjacent to and inside of the side frames 11 in the right-left direction, and supported to the side frames 11 so as to be movable among a plurality of positions including a first position (a position shown in FIG. 2) and a second position (a position shown in FIG. 3) arranged in the front-rear direction (a horizontal direction). The support member 9 includes a support surface 91 which supports the rear protrusions 65 of the belt unit 6 (a part of the belt unit 6) when the belt unit 6 is positioned at the first position, and an escape groove formed adjacent to the front end (one end) of the support surface 91. The escape groove 92 is formed to dent downward (i.e., has a concave shape so as to increase a distance between a surface of the escape groove 92 and the belt unit 6), and includes a front-side surface 92A, a rear-side surface 92B and a bottom surface 92C.

The front-side surface 92A is formed substantially along the up-down direction, and a release prevention portion 93 is provided on an upper side of the front-side surface 92A so as to extend rearward. The rear-side surface 92B inclines downward toward the front side (the rear-side surface 92 inclines toward the bottom surface 92C as a distance from the support surface 91 increases. The bottom surface 92C is formed substantially along the horizontal direction. The bottom surface 92C is preferably positioned such that a height difference between the bottom surface 92C and the support surface 91 is substantially same as a height difference between the first groove 13A and the third groove 13C, and such that when the bottom surface 92C supports the rear protrusions 65 of the belt unit 6, the belt unit 6 is separated from the photosensitive drums 51 (see FIG. 3).

The guide rails 13 and the support member 9 are one example of a guide member configured to movably guide the belt unit 6 between a position in which the belt unit 6 contacts the photosensitive drums 51 and a position in which the belt unit 6 is separated from the photosensitive drums 51 and enters the space A.

The main body 10 further includes a rear frame 14, and the rear opening portion 14A is formed in a lower portion of the rear frame 14 so as to allow the belt unit 6 to be attached to and detached from the main body 10.

<Method for Attaching/Detaching the Belt Unit>

Next, a method for attaching/detaching the belt unit 6 is described.

Figure 3:
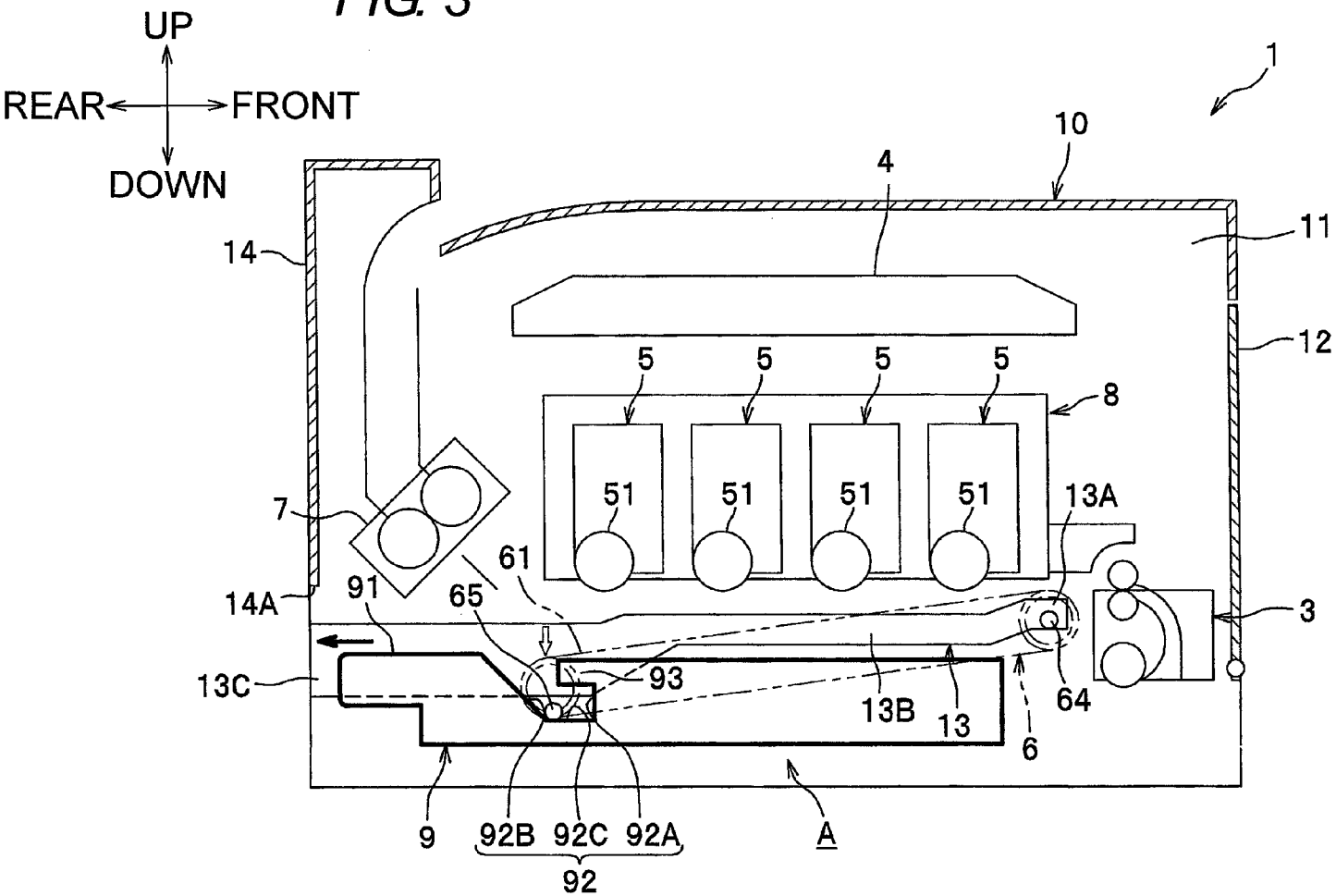
FIG. 3 is a diagram showing a state in which a belt unit is retracted from photosensitive drums in the first exemplary embodiment.

As shown in FIG. 2, when the belt unit 6 is detached from the main body 10, at first, an operator (e.g., a user or a repairperson) detaches the sheet feed tray 2 from the main body 10. Next, as shown in FIG. 3, when the operator pulls the support member 9 such that the support member 9 moves from the first position to the second position which are rear side of the first position, the rear protrusion 65 of the belt unit enters the escape groove 92 of the support member 9 by own weight of the belt unit 6. Accordingly, the belt unit 6 is inclined and enters the space A, and is separated from the photosensitive drums 51.

Figure 4:
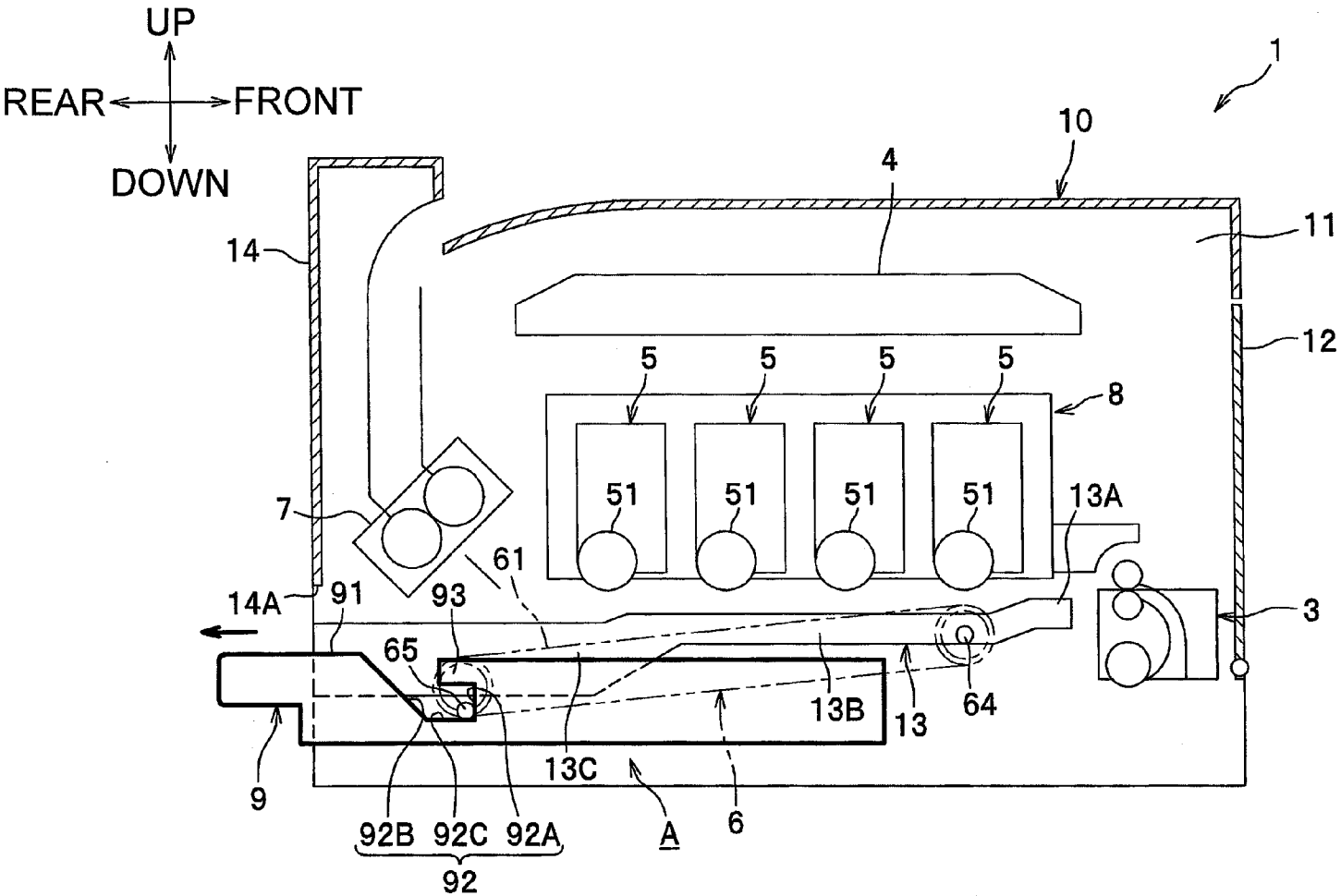
FIG. 4 is a diagram showing a state in which a rear protrusion of the belt unit is caught by a support member in the first exemplary embodiment.
Figure 5:
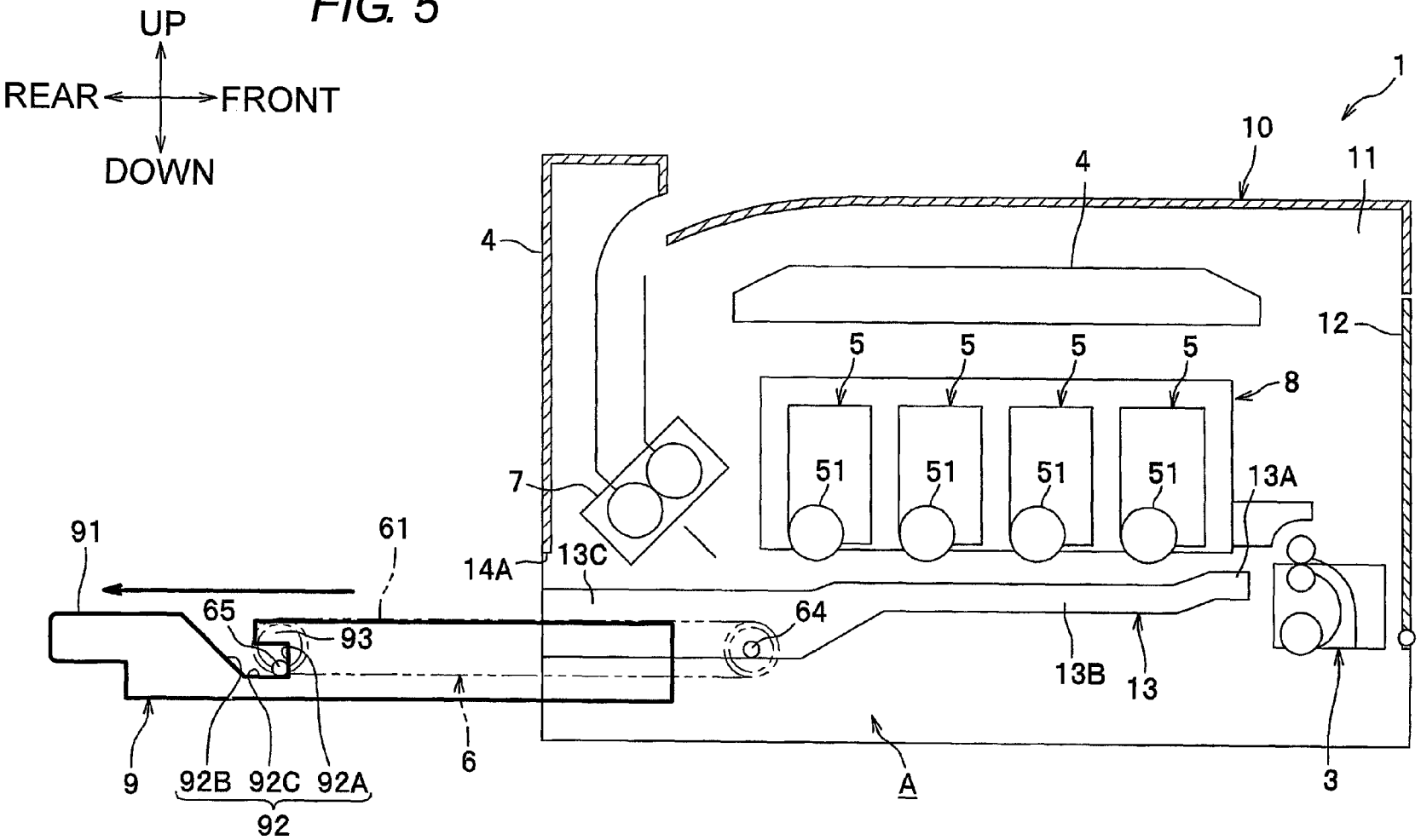
FIG. 5 is a diagram showing a state in which the belt unit is pulled out to the outside of the main body in the first exemplary embodiment.

Subsequently, the operator further pulls the support member 9 rearward, as shown in FIG. 4, the front-side surface 92A of the escape groove 92 of the support member 9 contacts the belt unit 6. In this state, when the operator further pulls the support member 9 rearward, the front protrusion 64 of the belt unit 6 moves in the order of the first groove 13A, the second groove 13B and the third groove 13C. That is, as shown in FIG. 5, the belt unit 6 is pulled out from the rear opening portion 14A of the main body 10 together with the support member 9 through the space A. Consequently, the pulled-out belt unit 6 can be cleaned, or can be removed from the support member 9 and the third groove 13C so as to exchange the belt unit 6.

When the belt unit 6 is attached to the main body 10, as shown in FIG. 5, the operator inserts the front protrusion 64 of a new belt unit 6 to the guide rail 13, and also inserts the rear protrusion 65 to the escape groove 92 of the support member 9. Next, the operator pushes the belt unit 6 into the main body 10 by the support member 9. Accordingly, the belt unit 6 is pressed by the inclined rear-side surface 92B of the escape groove 92 of the support member 9.

As shown in FIG. 3, when the front protrusion 64 of the belt unit 6 reaches the first groove 13A of the guide rail 13, the frontward movement of the belt unit 6 is stopped by a part of the main body 10, which positions the belt unit 6 in the front-rear direction. In this time, the rear protrusion 65 is pressed upward by the inclined rear-side surface 92B, which pivots the belt unit 6 upward around the front protrusion 64. Thereafter, as shown in FIG. 2, the rear protrusion 65 is supported by the support surface 91 of the support member 9, and the belt unit 6 is attached and positioned at the attached position.

According to this exemplified embodiment, the following advantages can be obtained.

The operator can perform the maintenance of the belt unit 6 by detaching the sheet feed tray 2 lighter in weight than the drawer 8 because of the structures thereof. Therefore, the maintenance work of the belt unit 6 can be facilitated. Even if the color printer 1 has a structure without the drawer, the belt unit can be detached by merely pulling out the sheet feed tray without detaching the plurality of photosensitive drums (process cartridges).

The guide rail 13 and the support member 9 guides the belt unit 6 to be movable between a position in which the belt unit 6 contacts the photosensitive drums 51 and a position in which the belt unit 6 is separated from the photosensitive drums 51 and enters the space A. Accordingly, the belt unit 6 can be detached without the contact between the belt unit 6 and the photosensitive drums. Therefore, the damages to the belt unit 6 and the photosensitive drums 51 can be prevented.

The color printer 1 includes the guide rail 13 configured to guide the belt unit 6 to the outside of the main body 10 in a state in which the belt unit 6 is separated from the photosensitive drums 51. Therefore, the belt unit 6 can be attached and/or detached while a posture of the belt unit 6 is kept stable.

The support member 9 can be moved so as to release the support of the belt unit 6 with respect to a horizontal position thereof. As a result, the belt unit 6 is separated from the photosensitive drums 51. Therefore, it is possible to prevent the damage to the photosensitive drums 51 caused by scraping the conveying belt 61 to the photosensitive drums 51 during the detachment of the belt unit 6. Further, the support member 9 can be used as a member for positioning the belt unit 6 in the up-down direction and a member for separating the belt unit 6 from the photosensitive drums 51. Therefore, the number of components (parts) of the color printer 1 can be reduced.

When the rear protrusion 65 enters the escape groove 92, the belt unit 6 is separated from the photosensitive drums 51, and in this state, the belt unit 6 can be pulled out together (integrally) with the support member 9. Therefore, by simply pulling out the support member 9, the belt unit 6 can be easily pulled out to the outside of the main body 10 after the belt unit 6 is separated from the photosensitive drums 51.

The rear-side surface 92B of the escape groove 92 inclines toward the bottom surface 92 as the distance from the support surface 91 increases. Accordingly, when the support member 9 is pushed into the main body 10 in a state in which the rear protrusion 65 is set within the escape groove 92, the rear protrusion 65 of the belt unit 6 can easily be raised to the attached position by virtue of the inclined rear-side 92B. Further, when the support member 9 is pulled out, since the belt unit 6 can be lowered smoothly while the rear protrusion 65 of the belt unit 6 is supported by the rear-side surface 92B. Therefore, the damage to the belt unit 6 can be provided.

In this exemplary embodiment, the sheet feed unit 3 is overlapped with the belt unit 6 as viewed from the front-rear direction. Therefore, even when the color printer 1 has a structure to prohibit the belt unit 6 from being completely pulled out (separated) from the main body 10 toward a front side, the belt unit 6 can be detached properly without contacting the sheet feed unit 3 through the space A defined below the sheet feed unit 3.

In this exemplary embodiment, the fixing device 7 is overlapped with the belt unit 6 as viewed from the front-rear direction. Therefore, even when the color printer 1 has a structure to prohibit the belt unit 6 from being completely pulled out (separated) from the main body 10 toward a front side, the belt unit 6 can be detached properly without contacting the fixing device 7 through the space A defined below the fixing device 7.

Even when the drawer 8 can not be separated from the main body 10 in a state in which the drawer 8 is pulled out, and the color printer 1 has a structure in which the belt unit 6 can not be pulled out from a space obtained by the detachment of the drawer 8, the belt unit 6 can properly be detached through the space A defined below the drawer.

The release prevention portion 93 is formed on an upper side of the front-side surface 92A of the escape groove 92. Therefore, the release prevention portion 93 can prevent the rear protrusion 65 of the belt unit 6 from exiting from the escape groove 92 upward.

The present invention is not limited to this exemplary embodiment, and various modifications, e.g., the following modifications, may be made.

In this exemplary embodiment, the belt unit 6 is pulled out from the main body 10 through the rear opening portion 14A, but the invention is not limited thereto. The belt unit 6 may be pulled out from the main body 10 through the pull-out port 12B (the pull-out port for the sheet feed tray 2) provided on a front side of the main body 10.

In this exemplary embodiment, the guide rail 13 has a groove shape, but the present invention is not limited thereto. The guide rail 13 may have a convex shape. In this case, the convex guide rail 13 may be engaged with a groove formed on a side surface of the belt unit 6.

In this exemplary embodiment, the escape groove 92 is formed in the support member 9. However, the present invention is not limited thereto, and the separation of the belt unit from the photosensitive drums may be realized by moving the support member to release the support of the belt unit. For example, the support member of the exemplary embodiment may be shaped a rectangular shape, and the belt unit 6 may be separated from the photosensitive drums 51 when the support member is separated from the rear protrusion 65 of the belt unit 6. Even in this case, the belt unit 6 separated from the photosensitive drums 51 moves to the space A formed by pulling out the sheet feed tray 2, the operator can directly grasp and pull out the belt unit 6.

In this exemplary embodiment, the support member 9 and the guide rail 13 is exemplified as an example of the guide member, but the present invention is not limited thereto. For example, a rail member for supporting the belt unit and pivotable in the up-down direction may be provided. In this case, the belt unit can be move to and away from the photosensitive drums while the belt unit is supported on the rail member.

In this exemplified embodiment, the process cartridges 5 and the belt unit 6 are arranged substantially along the horizontal direction, but the present invention is not limited thereto. The process cartridges 5 and the belt unit 6 may be arranged substantially along the up-down direction, and the sheet feed unit 3 may be arranged above the upper end or below the lower end of the belt unit 6.

In this exemplary embodiment, the conveying belt 61 is exemplified as an example of the belt, but the present invention is not limited thereto. For example, the belt may be an intermediate transfer belt on which a developing agent image carried on each of the photosensitive drums is transferred. That is, in this exemplary embodiment, the recording sheet P is placed on the conveying belt 61 and the image is directly transferred to the recording sheet P from the photosensitive drums 51. However, the image may be directly transferred to the conveying belt 61 from the photosensitive drums, and the image may further be transferred to the recording sheet P from the conveying belt 61.

(Second Exemplary Embodiment)

The second exemplary embodiment of the present invention is described with reference to the drawings.

Figure 6:
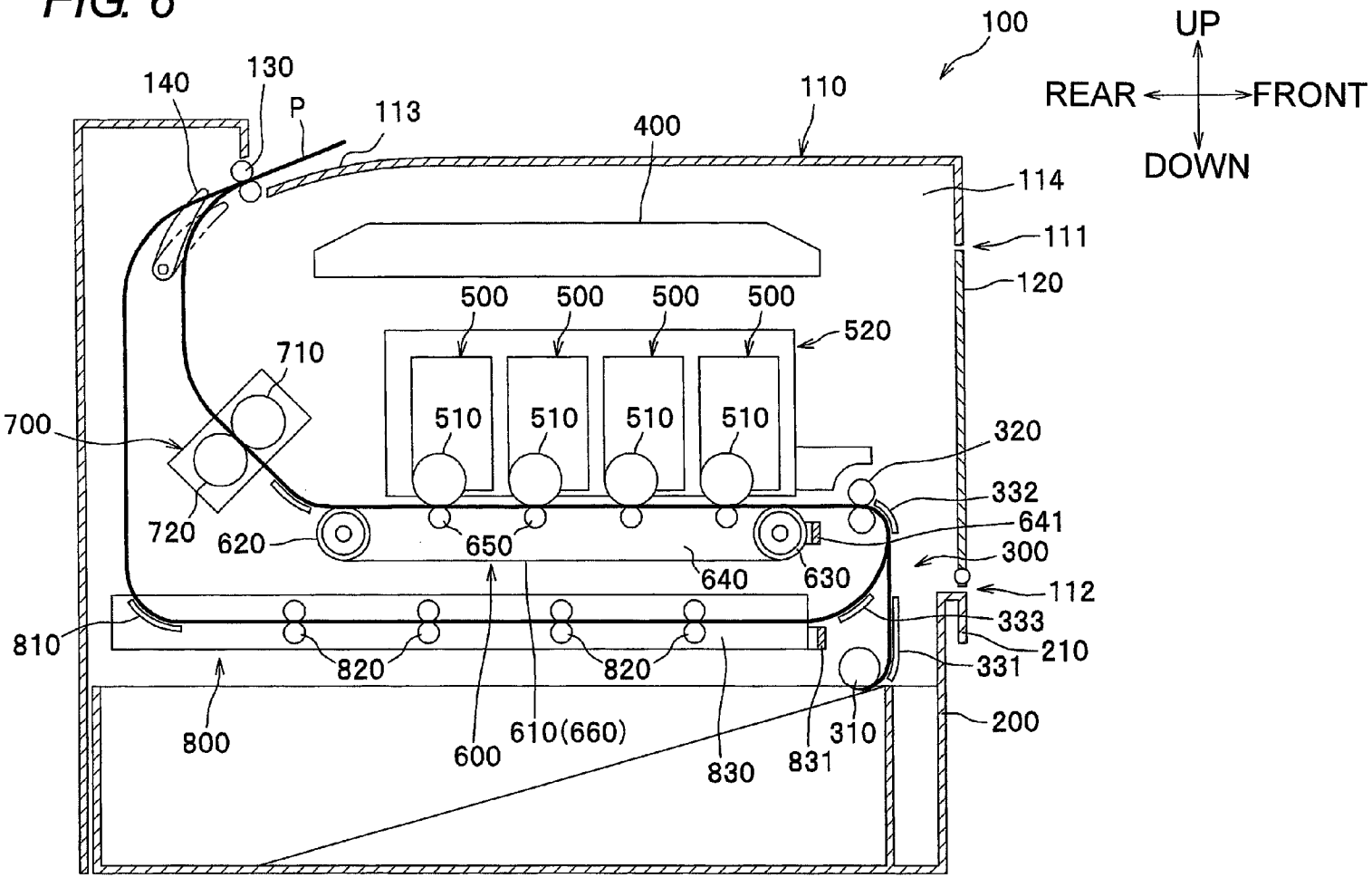
FIG. 6 is a diagram showing an entire configuration of a color printer as an example of an image forming apparatus according to a second exemplary embodiment.

As shown in FIG. 6, the color printer 100 includes: a sheet feed tray 200 as an example of the sheet storing unit; a sheet feed unit 300; a scanner unit 400; a plurality of process cartridges 500 as an example of the image forming unit; a sheet conveying belt unit 600 as an example of the belt unit; a fixing device 700; and a duplex conveying path unit 800 as an example of a conveying path unit, which are stored in a box-shaped main body 110.

In the color printer 100, the scanner unit 400, the process cartridges 500, the sheet conveying belt unit 600, the duplex conveying path unit 800 and the sheet feed tray 200 are arranged in this order from an upper side to a lower side. The sheet feed unit 300 is disposed on a front side of the sheet conveying belt unit 600 and the duplex conveying path unit 800, and the fixing device 700 is disposed on a rear side of the sheet conveying belt unit 600. On a front surface of the main body 110, an opening portion 111 and a pull-out port 112 are provided. The process cartridges 500 (a drawer 520) can be attached and detached through the opening portion 111, The sheet feed tray 200 can be attached and detached through the pull-out port 112. A front cover 120 is provided so as to open and close the opening portion 111.

The sheet feed tray 200 is a tray configured to store a sheet P as an example of a recording sheet. The sheet feed tray 200 is movable (slidable) in a front-rear direction and can be attached to and detachable from the main body 110 through the front side thereof. On a front surface of the sheet feed tray 200, a grip portion 210 grasped by a user is provided.

The sheet feed unit 300 is a device configured to supply the recording sheet P stored in the sheet feed tray 200 and the recording sheet P conveyed from the duplex conveying path unit 800 to the belt unit 600. The sheet feed unit 300 includes: a feed roller 310 contacting the recording sheet P stored in the sheet feed tray 200; a registration roller configured to control a position of a leading end of the recording sheet P; sheet feed guide members 331 and 332 configured to guide the recording sheet P from the feed roller 310 to the registration roller 320; a duplex guide member 333 configured to guide the recording sheet P conveyed from the duplex conveying path unit 800 to the registration roller 320.

The scanner unit 400 includes a known configuration, for example, a laser beam generation unit, a polygon mirror, a lens, and a reflecting mirror which are not shown. The scanner unit 400 irradiates the laser beams on each of surfaces of photosensitive drums 510 of the process cartridges 500 by fast scanning.

Each of the process cartridges 500 includes the photosensitive drum 510 on which an electrostatic latent image is formed. In addition, the process cartridge 500 further includes a charger, a toner accommodating chamber, a supply roller and a developing roller. The process cartridges 500 are aligned in the front-rear direction and integrally supported to the drawer 520. The drawer 520 is supported on guide rails (not shown) provided on a pair of side frames 110 defining right and left side walls of the main body 110 so as to be movable in the front-rear direction. Accordingly, the drawer 520 can be pulled out to the outside of the main body through the opening portion 111 that is formed by opening the front cover 120.

In the process cartridge 500, the photosensitive drum 510 is charged by the charger and then exposed by the laser beam emitted from the scanner unit 400. Accordingly, the electrostatic latent image is formed on the surface of the photosensitive drum 510. Thereafter, toner (developing agent) accommodated in the toner accommodating chamber is supplied to the electrostatic latent image formed on the photosensitive drum 510 by the supply roller, etc. Accordingly, a toner image (developing agent image) is carried on the photosensitive drum 510.

The sheet conveying belt unit 600 includes: the conveying belt 610 of an endless belt which oppose the photosensitive drums 510; a drive roller 620 and a driven roller 630 configured to allow the conveying belt 610 to stretch therebetween and rotate; and a frame 640 that rotatably supports the rollers 620 and 630. The belt sheet conveying unit 600 is attachable to/detachable from the main body 110 through the pull-out port 112 for the sheet feed tray 200 formed on the front surface of the main body 110. The detail of mechanism for attaching/detaching the sheet conveying belt unit 600 will be described later.

The sheet conveying belt unit 600 allows the recording sheet P to be placed on an upper surface of the belt 610 (a surface closer to the photosensitive drums 510) and to be conveyed by rotating the belt 610 and the photosensitive drums 510 while the recording sheet P is nipped therebetween. During the conveyance of the recording sheet P, the toner images of photosensitive drums 510 are transferred to the recording sheet P by a plurality of a plurality of transfer rollers 650 provided in a region enclosed by the conveying belt 61.

The fixing device 700 is a device for thermally fixing the toner image transferred to the recording sheet P. The fixing device 7 includes a heat roller 710 and a pressure roller 720. The recording sheet P which has been thermally fixed by the fixing device 700 is discharged to a discharge tray 113 formed on the main body 110 by the discharge roller 130.

When a duplex printing is performed, the discharge roller 130 is reversed before the recording sheet P is entirely discharged to the discharge tray 113, so as to return the recording sheet P into the main body 110. The recording sheet P returned to the inside of the main body 110 is guided by a flapper 140 pivoted downward. Consequently, the recording sheet P is passed through a rear side of the fixing device 700 and conveyed to the duplex conveying path unit 800.

The duplex conveying path unit 800 is a conveying device for a duplex conveyance, and is disposed on an opposite side of the process cartridges 500 across the sheet conveying belt unit 600. As used herein, the term "duplex conveyance" is a conveyance in which, in order to print the rear side of the recording sheet P of which the front side has been printed, the recording sheet P in a reversed state is returned to an upstream side of the process cartridges 500 in a sheet conveying direction.

The duplex conveying path unit 800 includes: a guide member 810 configured to change a conveying direction of the recording sheet P conveyed downward through the rear side of the fixing device 700 toward the front side; a plurality of pairs of return rollers 820 aligned along the front-rear direction so as to convey the recording sheet guided by the guide member 810 toward the front side; and a frame 830 to which the guide member 810 is fixed and which rotatably support the return rollers 820.

The duplex conveying path unit 800 convey the recording sheet P substantially along the horizontal direction, specifically, substantially along a belt surface 660 of the conveying path unit belt unit 600 (a outer surface of the belt 610 opposing the duplex conveying path unit 800). The detail of the mechanism for supporting the duplex conveying path unit 800 by the main body 110 will be described later.

<Mechanism for Attaching/Detaching Sheet Conveying Belt Unit>

Next, the mechanism for attaching/detaching the sheet conveying belt unit 600 is described in detail.

Figure 7:
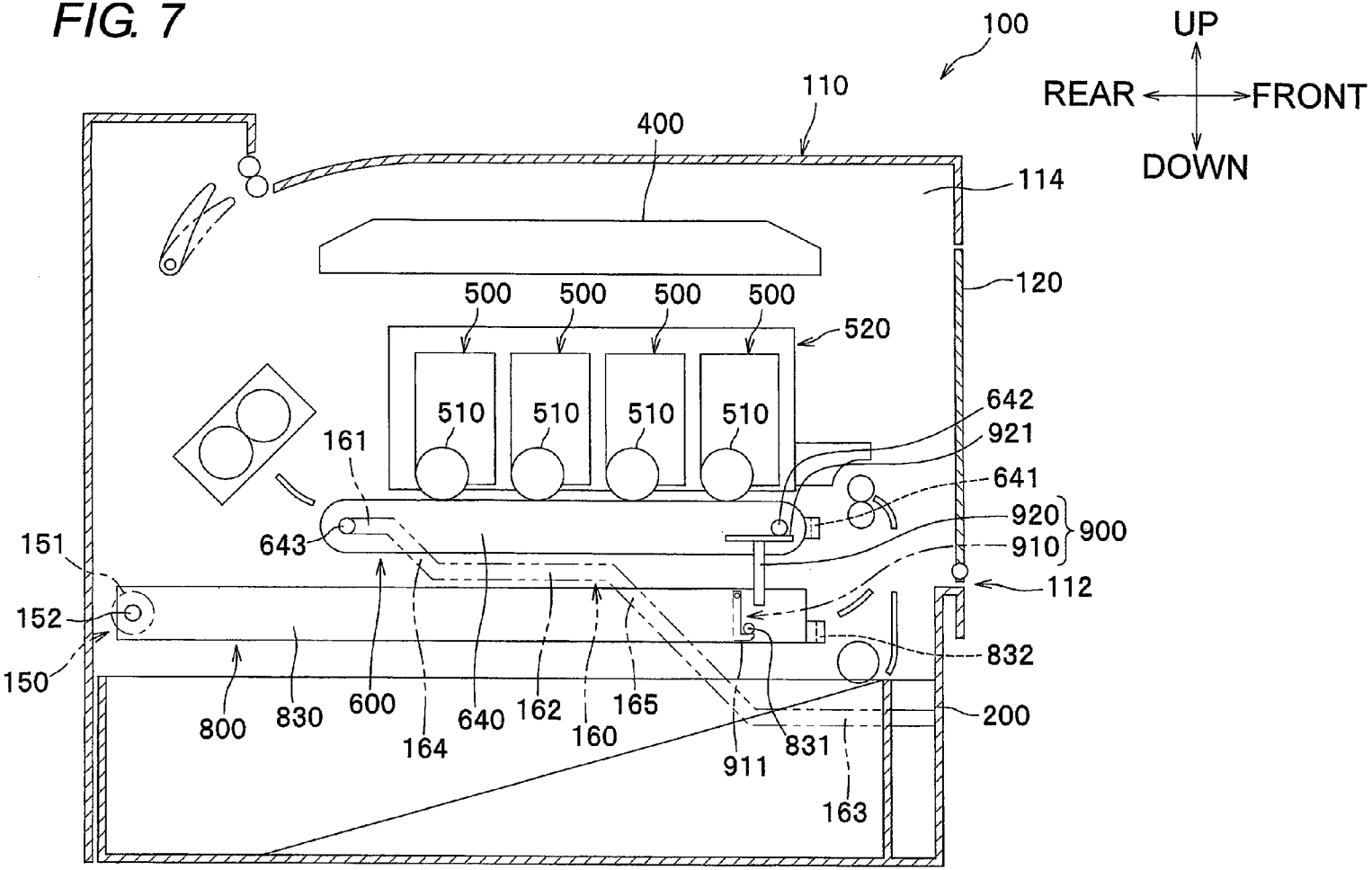
FIG. 7 a diagram showing a mechanism for attaching/detaching a sheet conveying belt unit in the second exemplary embodiment.

As shown in FIG. 7, the color printer 100 further includes: a retracting mechanism 150 configured to retract the duplex conveying path unit 800 to a space 51 (see FIG. 9) in which the sheet feed tray 200 is provided; a holding mechanism 900 configured to detachably hold the sheet conveying belt unit 600 through the duplex conveying path unit 800.

The retracting unit 150 includes: a pair of bearing members 151 respectively provided on the right and left side frames 114 of the main body 110; and a pair of rotation shaft portions 152 respectively provided on rear portions of right and left frames 830 of the duplex conveying path unit 800 so as to protrude outward in the right and left direction.

Each of the bearing members 151 rotatably supports a corresponding one of the rotation shaft portion 152. Consequently, the duplex conveying path unit 800 is pivotably supported to the main body 110 such that pivot axis is located at the rotation shaft portion 152 provided a rear portion of the duplex conveying path unit 800 and a pivot end is located at a front portion of the duplex conveying path unit 800. In other words, the pivot end (front end) of the duplex conveying path unit 800 is disposed on a near side to the pull-out port 112 as an example of an opening portion for picking up the recording sheet P.

As used herein, the term "opening portion for picking up the recording sheet P" means an opening (the pull-out port 112) for picking up the recording sheet P together with the sheet feed tray 200 (sheet storing unit) in this exemplary embodiment. When the sheet storing unit is not detachable from the main body 110, the term "opening portion" means an opening formed in the sheet storing unit as a part of the main body 110.

The holding mechanism 900 includes: a lock mechanism 910 provided at the main body 110; and a pair of support arms 920 as an example of the support portion configured to support the sheet conveying belt unit 600.

The lock mechanism 910 is a mechanism configured to hold the duplex conveying path unit 800 to the main body 110. The lock mechanism 910 includes: a pair of hooks 911 rotatably provided at the right and left side frames 114 of the main body 110, respectively; and urging members (not shown), such as torsion springs, configured to urge the hooks 911 to a predetermined positions. Each of the hooks 911 is bent-formed to have an L-shape, and one end thereof is rotatably supported to the side frame 114.

On a front portion of the right and left frames 830 of the duplex conveying path unit 800, a pair of engagement protrusions 831 are provided so as to protrude toward outside in the right and left directions. Each of the engagement protrusion 831 is supported at the other end portion of the hook 911.

Each of the support arms 920 is a member having a substantially T-shape, and the front upper portion of corresponding one of the right and left frames 830 of the duplex conveying path unit 800. On the right and left frames 640 of the sheet conveying belt unit 600, a pair of front protrusion 642 and a pair of rear protrusions 643 are provided. The front protrusions 642 are spaced from the rear protrusions 643 in the front-rear direction, and the front and rear protrusions 642 and 643 protrude toward outside in the right and left direction.

The rear protrusions 643 are supported by guide grooves 160 of the side frames 114, and the front protrusions 642 are supported by the support arms 920. Consequently, the sheet conveying belt unit 600 is held at an attached position (a position shown in FIG. 7: a position for an image formation operation). The front protrusions 642 of the sheet conveying belt unit 600 are disposed inside of the main body 110 than the respective guide groove 160 in the right-left direction so as not to enter the guide grooves 160.

Therefore, when the duplex conveying path unit 800 is pivoted, the sheet conveying belt unit 600 supported by the support arms 920 is pivoted together with the duplex conveying path unit around the rear protrusions 643 as the pivot axis. That is, since the front end (front protrusion 642) as the pivot end on a side closer to the pull-out port 112 is supported by the front end (the support arm 920) as the pivot end of the duplex conveying path unit 800, the front end of the sheet conveying belt unit 600 moves in the up-down direction in response to the up-down movement of the duplex conveying path unit 800. Accordingly, the sheet conveying belt unit 600 is pivoted.

Figure 9:
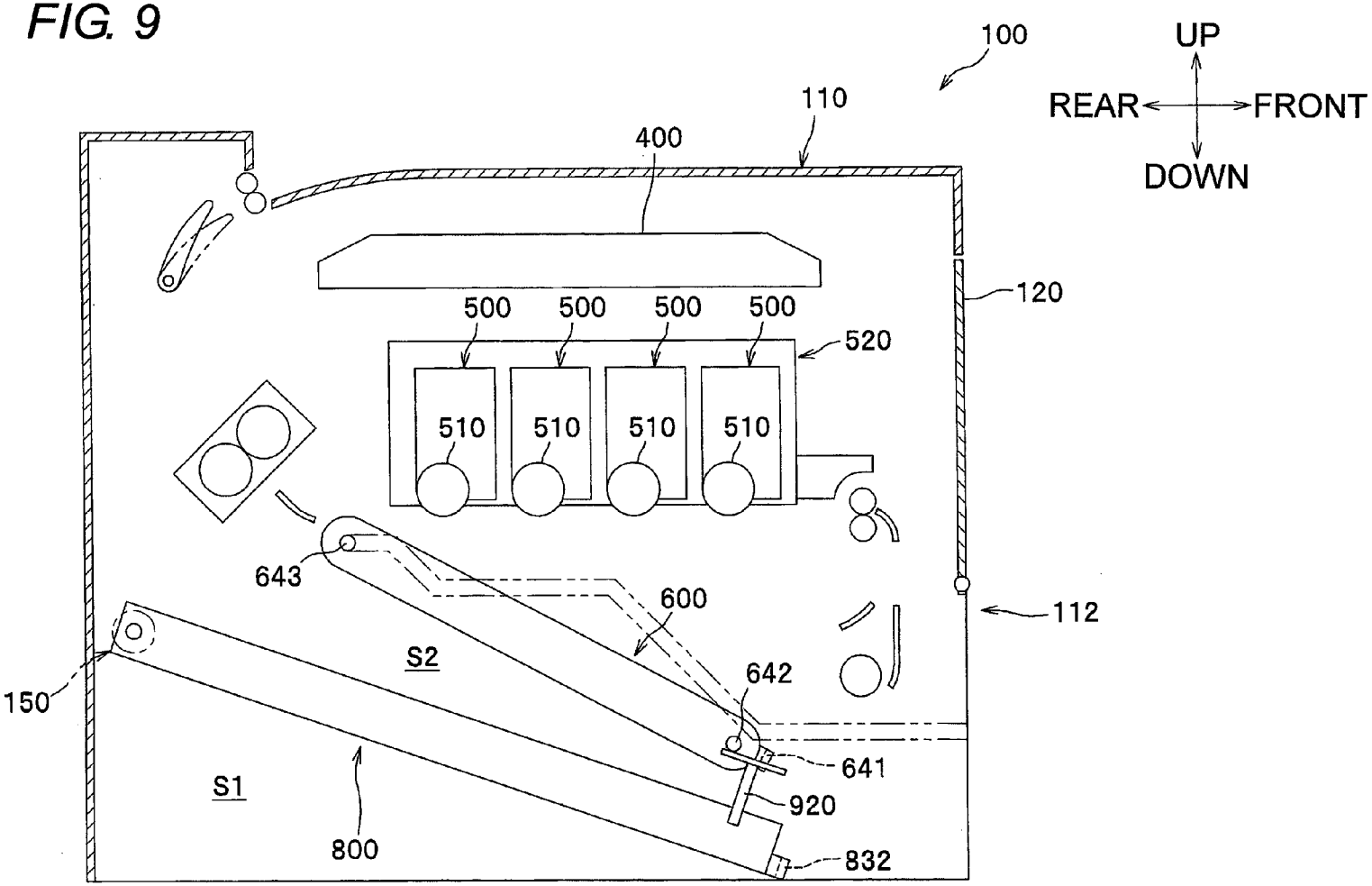
FIG. 9 is a diagram showing a sate in which the sheet conveying belt unit and a duplex conveying path unit is swung downward in the second exemplary embodiment.

An upper surface 921 of the support arm 920 has a length to keep a support of the front protrusion 642 of the sheet conveying path unit 600 even when the duplex conveying path unit 800 is pivoted to a refracted position (lowermost position of the movable range) (see FIG. 9). That is, the support arm 920 is configured to support and slide-contact the front protrusion 642 during a pivot movement of the duplex conveying path unit 800 between a holding position (a position shown in FIG. 7) in which the duplex conveying path unit 800 is held by the main body 110 and the retracted position (a position shown in FIG. 9).

The guide grooves 160 are formed in the right and left side frames 114 of the main body 110. Each of the guide grooves 160 supports the rear protrusion 643 of the sheet conveying belt unit 600 and guides the sheet conveying belt unit 600 to the outside or inside of the main body 110. That is, each of the side frames 114 can function as a guide member which allows the sheet conveying belt unit 600 to be pulled out from the inside of the main body 110 to the outside thereof or to be inserted into the main body 110 from an outside thereof.

Specifically, the guide groove 160 includes a fist groove 161, a second groove 162 and a third groove 163. The first groove 161 supports the rear protrusion 643 when the sheet conveying belt unit 600 is positioned at an attached position (the position shown in FIG. 7). The second groove 162 is formed at an obliquely front lower position of the first groove 161. The third groove 163 is formed at an obliquely front lower position of the second groove 162. The third groove 163 is opened to the outside of the main body 110 through the pull-out port 112. Consequently, the sheet conveying belt unit 600 is detachably attachable to the main body 110 through the pull-out port 112.

The first groove 61, the second groove 162 and the third groove 163 extend substantially along the front-rear direction, and are continuously connected via rear and front connection grooves 164 and 165 which obliquely extend. A rear end of the rear connection groove 164 (a position at which the rear connection groove begins to incline downward from the first groove) is positioned on a rear side of the rearmost photosensitive drum 510, which can prevent interference between a periphery portion of the rear protrusion 643 of the sheet conveying belt unit 600 guided by the guide groove 160, and the rearmost photosensitive drum 510. The guide groove 160 is formed at a position spaced at a predetermined distance from the duplex conveying path unit 800 positioned at the retracted position, which can prevent interference between a periphery portion of the rear protrusion 643 of the sheet conveying belt unit 600 and the duplex conveying path unit 800.

A grip portion 641 grasped by a user or worker is formed at a front portion of the frame 640 of the sheet conveying belt unit 600. Further, a grip portion 832 grasped by a user is formed at a front portion of the frame 830 of the duplex conveying path unit 800.

<Method for Attaching/Detaching Belt Unit>

Next, the method for attaching/detaching the sheet conveying belt unit 6 is described in detail.

Figure 8:
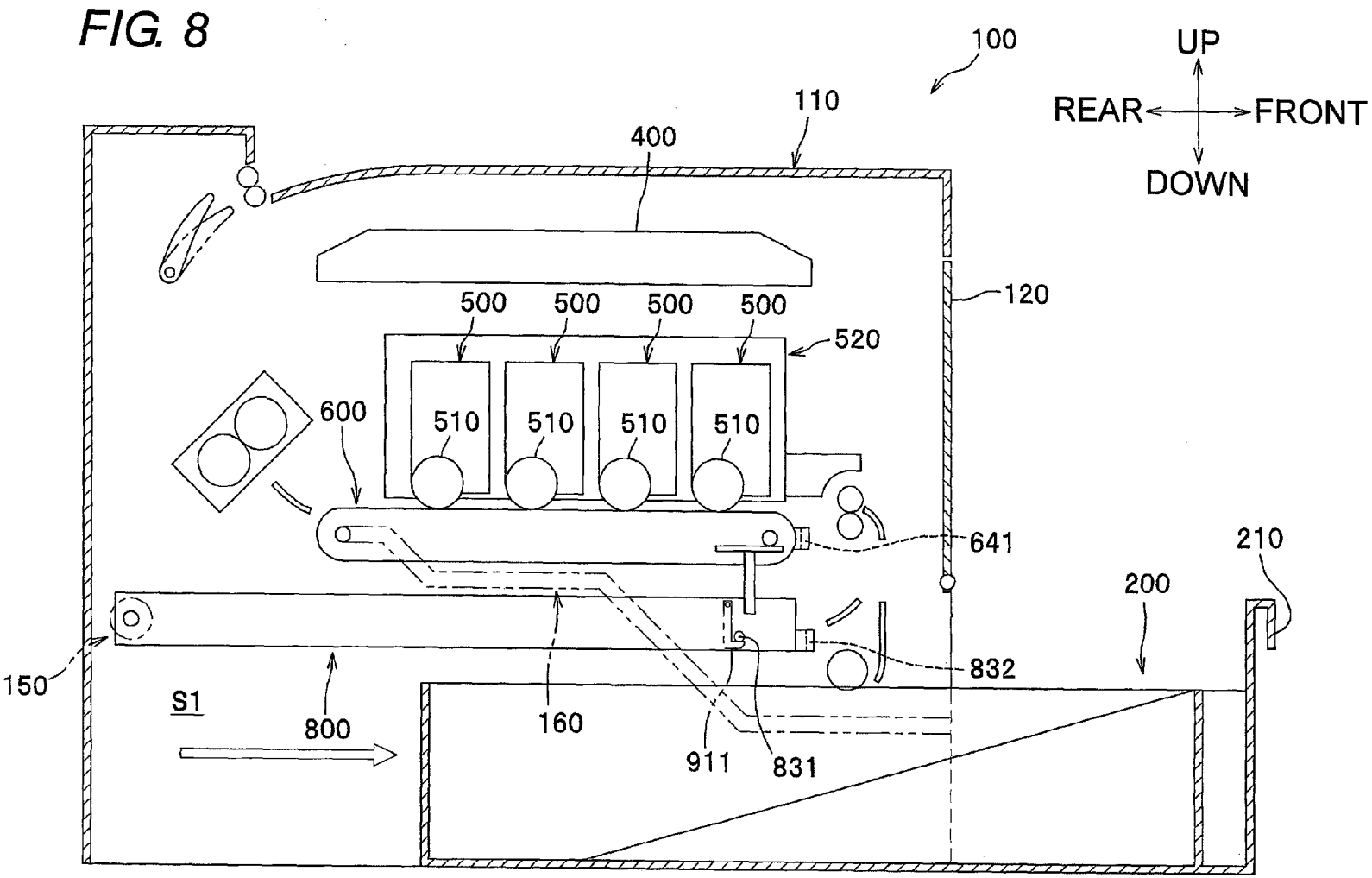
FIG. 8 is a diagram showing a state in which the sheet feed tray is pulled out from the main body in the second exemplary embodiment.

When the sheet conveying belt unit 600 is detached from the main body 110, the user picks the grip portion 210 of the sheet feed tray 200 with his finger and pull out the sheet feed tray 200 as shown in FIG. 8, thereby removing the sheet feed tray 200 from the main body 110.

Thereafter, while the user holds the grip portion 832 of the duplex conveying path unit 800, the user disengage the hook 911 from the engagement protrusion 831 of the duplex conveying path unit 800 and moves the duplex conveying path unit 800 downward. Consequently, as shown in FIG. 9, the sheet conveying belt unit 600 is pivoted downward together with the duplex conveying path unit 800. Accordingly, since the sheet conveying belt unit 600 is separated from the photosensitive drums 510, when the recording sheet P is jammed between the sheet conveying belt unit 600 and the photosensitive drums 510, the jammed recording sheet P is placed on the conveying path belt unit 600 or is slid on the upper surface of the inclined sheet conveying belt unit 600 and falls to the pull-out port 112 side. Therefore, the user can easily perform a process in which the user enters his hand into the main body 110 through the pull-out port 112, and picks up the jammed recording sheet P (this process is also referred to as "fixing a paper jam").

When the sheet conveying belt unit 600 is pivoted downward together with the duplex conveying path unit 800, the grip portion 641 of the sheet conveying belt unit 600 is exposed to the outside of the main body 110 through the pull-out port 112. Accordingly, the user can easily grasp the grip portion 641.

Figure 10:
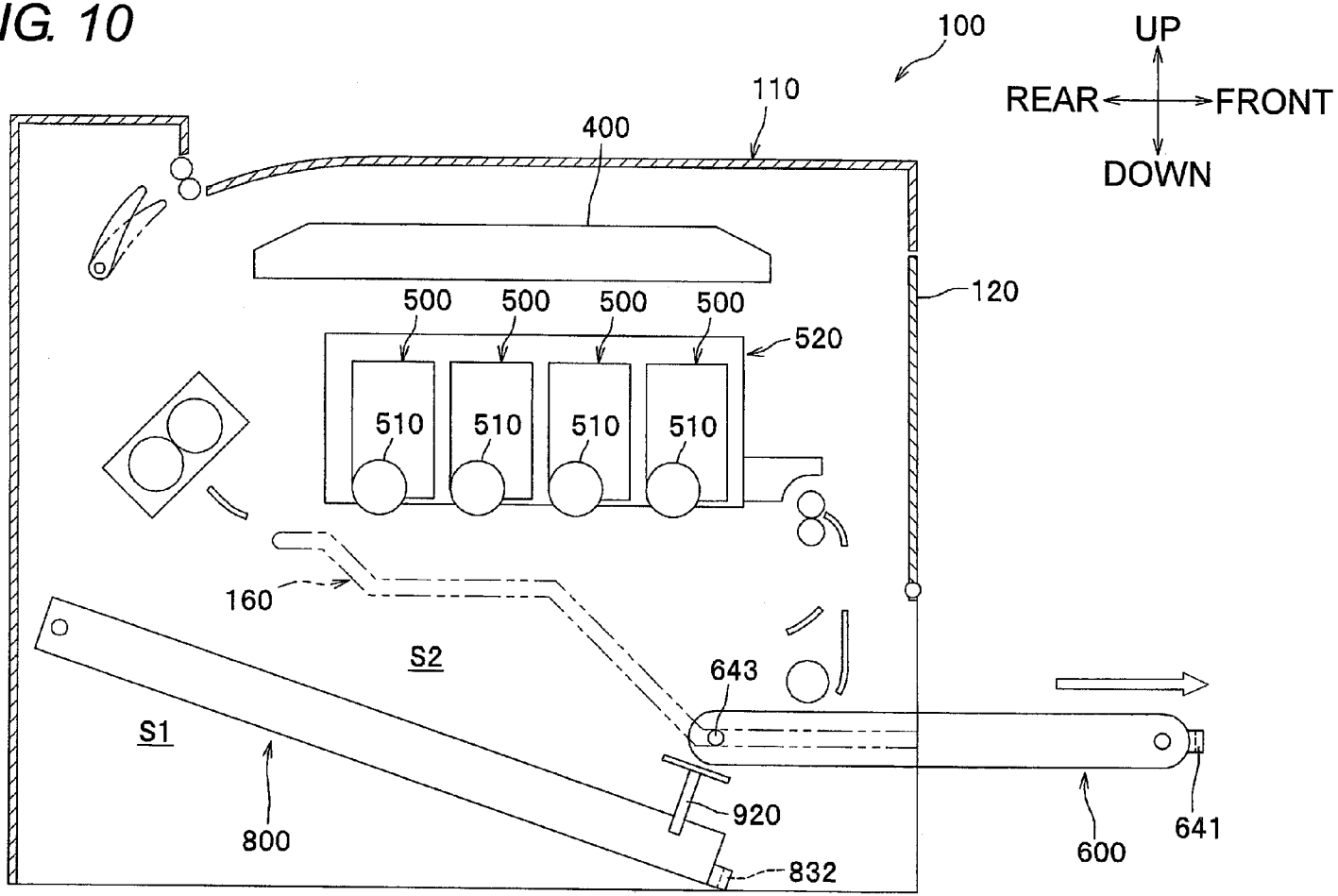
FIG. 10 is a diagram showing an operation for detaching the sheet conveying belt unit from the main body in the second exemplary embodiment.

Thereafter, when the user grasps the grip portion 641 exposed outside and then slightly lifts and pulls the grip portion 641, as shown in FIG. 10, the rear protrusion 643 is guided by the guide groove 160. Accordingly, the sheet conveying belt unit 600 is pulled out through the pull-out port 112 without any interference between the photosensitive drums 510 and the duplex conveying path unit 800, and the maintenance of the sheet conveying belt unit 600 (such as exchange or cleaning) can be performed. In other words, the sheet conveying belt unit 600 moves (is displaced) to the space S1 which the sheet feed tray 200 has existed through the space S2 which the duplex conveying path unit has existed, and thereafter the sheet conveying belt unit 600 is removed from the main body 110 and the maintenance is performed.

When the sheet conveying belt unit 600 is attached to the main body 110, the user insert the rear protrusion 643 of the sheet conveying belt unit 600 to the rear end of the guide groove 160, so as to place the front protrusion 642 on the support arm 920 of the duplex conveying path unit 800 ⑦, as shown in FIG. 9. Thereafter, the user grasps and lifts the grip portion 832 of the duplex conveying path unit 800. Accordingly, as shown in FIG. 8, the front end of the duplex conveying path unit 800 and the front end of the sheet conveying belt unit 600 are pivoted upward together.

When the front end of the duplex conveying path unit 800 is lifted at a predetermined position, the hook 911 is pushed and moved rearward by the engagement protrusion 831 of the duplex conveying path unit 800, and thereafter, the hook 911 is engaged with the engagement protrusion 831 by an urging force of the urging member. Consequently, the duplex conveying path unit 800 and the sheet conveying belt unit 600 are attached to the main body 110.

According to this exemplified embodiment, the following advantages can be obtained.

The sheet conveying belt unit 600 is detached from and attached to the main body 110 through the pull-out port 112 for the sheet feed tray 200. Consequently, it is unnecessary to cut the connection between the drive source of the main body 110 and the process cartridges 500 and also unnecessary to detach the drawer 520 having relatively heavy weight from the main body 520. Therefore, it is possible to facilitate the maintenance work of the sheet conveying belt unit 600.

The sheet feed tray 200 slidable with respect to the main body 110 is adopted as the sheet storing portion. Therefore, even when the recording sheet P is removed from the sheet feed tray 200, the space S1 for the maintenance can easily formed by removing the recording sheet P together with the sheet feed tray 200. That is, when the sheet storing portion is formed as a part of the main body, it is necessary to remove all the recording sheet from the sheet storing portion. Therefore, when the number of the recording sheets in the sheet storing portion is too large for the user to grasp, the user has to remove the recording sheets a plurality of times. However, according to this exemplary embodiment, it is unnecessary to such removal works, the space S1 for the maintenance can be easily formed.

The sheet conveying belt unit 600 is supported on the support arm 920 of the duplex conveying path unit 800. Consequently, the duplex conveying path unit 800 and the sheet conveying belt unit 600 can be operated together. Therefore, it is possible to easily perform the maintenance work of the sheet conveying belt unit 600.

Both the duplex conveying path unit 800 and the sheet conveying belt unit 600 are held by one (single9 lock mechanism 910. Therefore, as compared with a case in which separated lock mechanism for the duplex conveying path unit and the sheet conveying belt unit, respectively, are formed, the number of components (parts) can be reduced.

Since the pivot end (front end) of the duplex conveying path unit 800 is disposed on the pull-out port 112 side, after the sheet conveying belt unit 600 is detached from the main body 110, the upper portion of the inclined duplex conveying path unit 800 faces the pull-out port 112. Therefore, as long as an upper portion of the frame 830 of the duplex conveying path unit 800 is opened, for example even when the recording sheet P is jammed between the return rollers 820 provided inside the duplex conveying path unit 800, by entering the user's hand through the pull-out port 112, the user can easily fix the paper jam without detaching the duplex conveying path unit 800 from the main body 110. Further, for example when the foreign matter such as dust is adhered to the return roller 820 (especially, the return roller 820 disposed at front side among the return rollers 820), by inserting a cleaning device through the pull-out port 112, the user can easily clean the return roller 820.

If the pivot axis of the duplex conveying path unit 800 is located at the front end (an end on the pull-out port 112 side) of the duplex conveying path unit 800 in contrast to this exemplary embodiment, it is necessary to provide an additional opening for the maintenance at a rear end of the main body 110. However, according to this exemplary embodiment, the pull-out port 112 of the sheet feed tray 200 can be used as the opening for the maintenance. Therefore, the configuration of the color printer 100 can be simplified.

The pivot end (front end) of the sheet conveying belt unit 600 is provided on the pull-out port 112 side. Consequently, when the sheet conveying belt unit 600 is inclined downward together with the duplex conveying path unit 800, the upper surface of the sheet conveying belt unit 600 faces toward the pull-out port 112. Therefore, to fix the paper jam between the sheet conveying belt unit 600 and the photosensitive drums 510 or to clean the belt 610 can easily performed, without the detachment of the sheet conveying belt unit 600 from the main body 110.

If the pivot axis of the sheet conveying belt unit 600 is located at the front end (an end on the pull-out port 112 side) of the sheet conveying belt unit 600 in contrast to this exemplary embodiment, it is necessary to provide an additional opening for the maintenance at a rear end (an opposite side of the pull-out port 112) of the main body 110. However, according to this exemplary embodiment, the pull-out port 112 of the sheet feed tray 200 can be used as the opening for the maintenance. Therefore, the configuration of the color printer 100 can be simplified.

The sheet conveying belt unit 600 can be detached from and attached to the main body 110 while the guide groove 160 guides the sheet conveying belt unit, the interference between the sheet conveying belt unit 600 and other members (such as the photosensitive drums 510 and the duplex conveying path unit 800) can be prevented.

The sheet conveying belt unit 600 is guided while the rear protrusion 643 as the pivot axis of the sheet conveying belt unit 600 is guided by the guide groove 160. Therefore, as compared with a configuration in which a member for pivotably support the sheet conveying belt unit 600 and a guide member for guiding the sheet conveying belt unit 600 are separately provided, the configuration of the color printer 100 can be simplified.

The present invention is not limited to this exemplary embodiment, and various modifications, e.g., the following modifications, may be made.

Figure 11A:
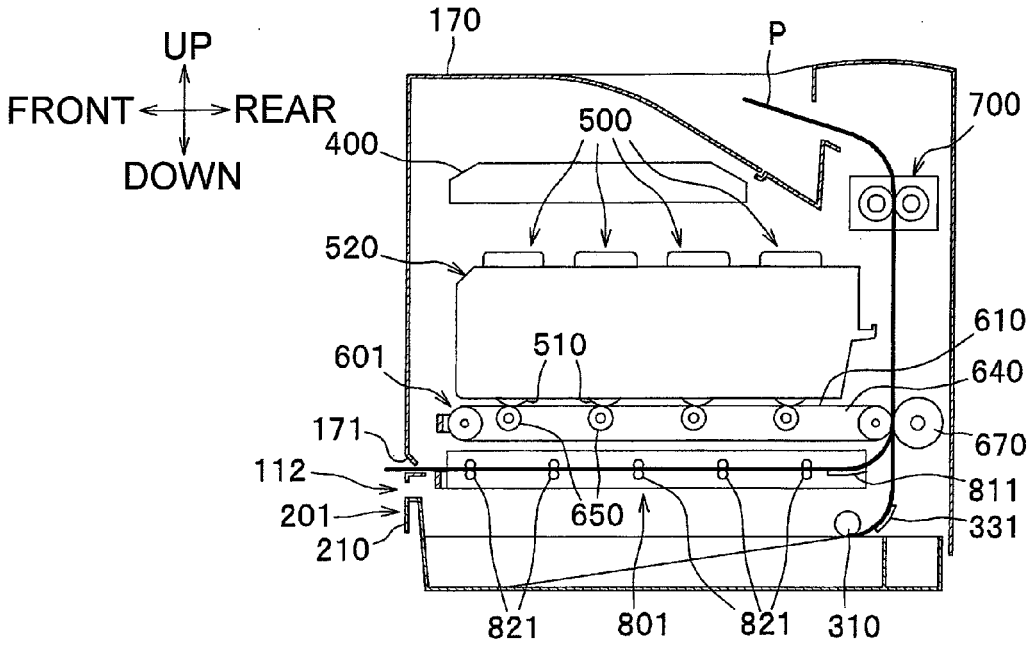

In this exemplified embodiment, the sheet conveying belt unit 600 configured to convey the recording sheet P is exemplified as the belt unit, and the duplex conveying path unit 800 for the duplex conveyance is exemplified as the conveying path unit. However, the present invention is not limited thereto. For example, as shown in FIG. 11A, an intermediate transfer belt unit 601 on which an image is formed by each of the process cartridges 500 (the image forming unit) may be adopted as the belt unit, and a manual-feed conveying path unit 801 configured to convey the recording sheet P which is inserted by a manual feed may be adopted as the conveying path unit. Here, in FIGS. 11A and 11B and FIGS. 12A and 12B, elements having configurations and functions substantially the same as those of the second exemplified embodiment is denoted by the same reference numerals, and the description thereof is omitted.

As shown in FIG. 11A, the intermediate transfer belt unit 601 is disposed below the process cartridges 500 so as to oppose the process cartridges 500, and the manual-feed conveying path unit 801 is disposed between the intermediate transfer belt unit 601 and the sheet feed tray 201. Here, the sheet feed tray 201 is different from the second exemplary embodiment in that the grip portion 210 is provided on an opposite side of the feed roller 310, etc, and other configuration thereof is substantially the same as that of the second exemplified embodiment.

The intermediate transfer belt unit 601 has substantially the same configuration as the sheet conveying belt unit 600 of the second exemplified embodiment, but is different in that each of the transfer rollers 650 functions as a first-stage transfer roller configured to transfer the toner image from each of the photosensitive drums 510 to the belt 610. The toner image transferred to the belt 610 is transferred to the recording sheet P by a second-stage transfer roller 670 provided adjacent to a rear side of the belt 610.

The manual-feed conveying path unit 801 includes a plurality pairs of conveying rollers 821 and a guide member 811. The conveying rollers 821 convey the recording sheet P inserted from a manual-feed port 171 formed in a front wall of a main body 170 in a rear direction. The guide member 811 guides the recording sheet P conveyed by the conveying rollers 821 to a portion between the second-stage transfer roller 670 and the belt 610.

Figure 11B:
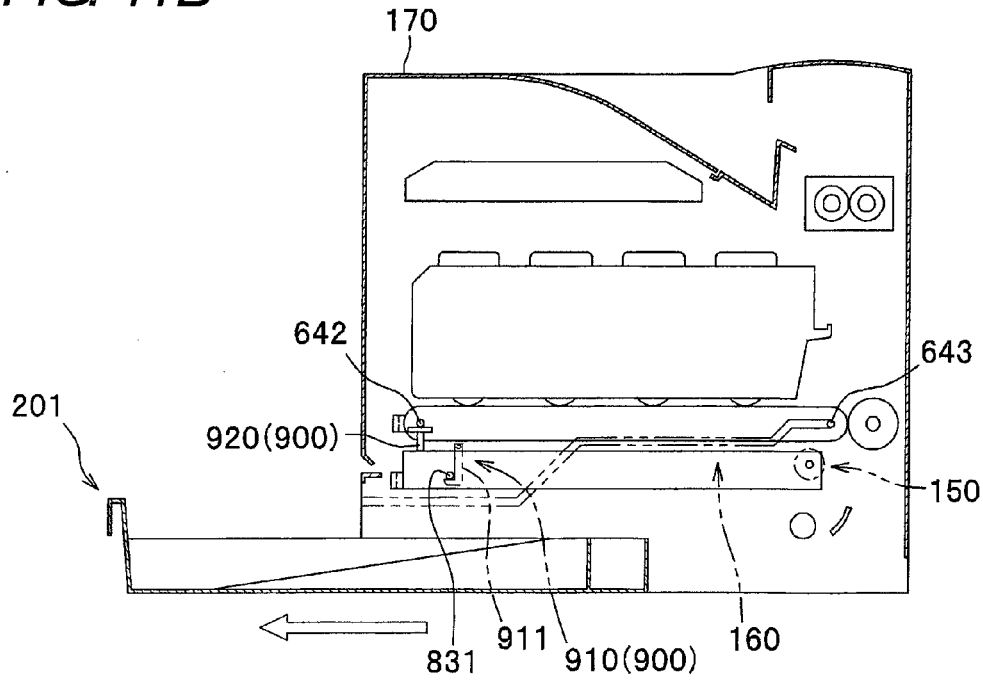

As shown in FIG. 11B, in the intermediate transfer belt unit 601, the manual-feed conveying path unit 801 and the main body 170, similar to the second exemplary embodiment, the front protrusion 642, the rear protrusion 643, the engagement protrusion 831, the holding mechanism 900 (the lock mechanism 910 and the support arm 920), the retracting mechanism 150 and the guide groove 160 are formed.

Figure 12A:
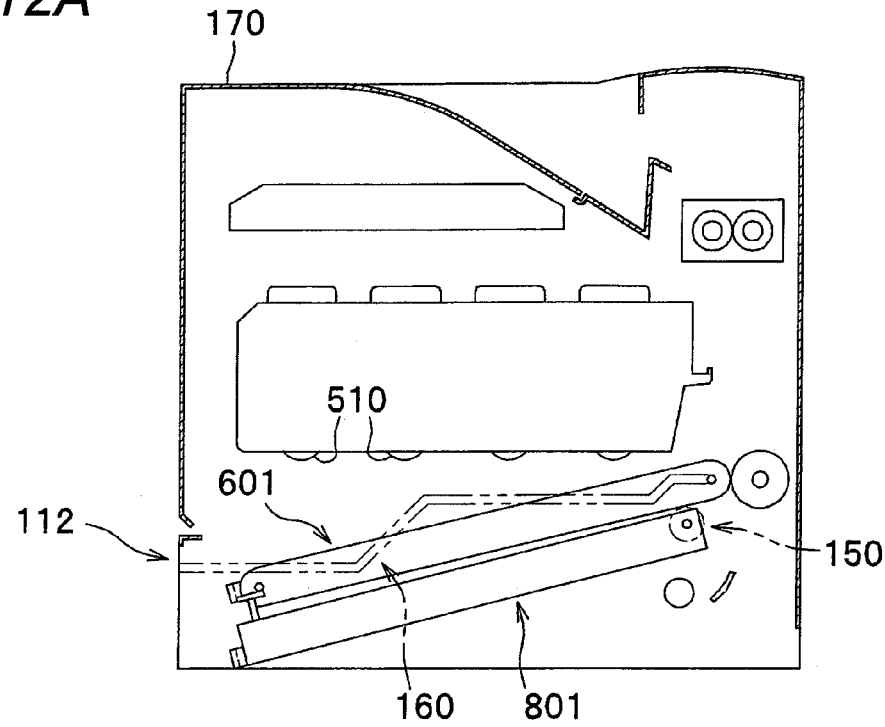
FIG. 12A is a diagram showing a state in which an intermediate transfer belt unit shown in FIG. 11A and a manual-feed conveying path unit is swung downward.
Figure 12B:
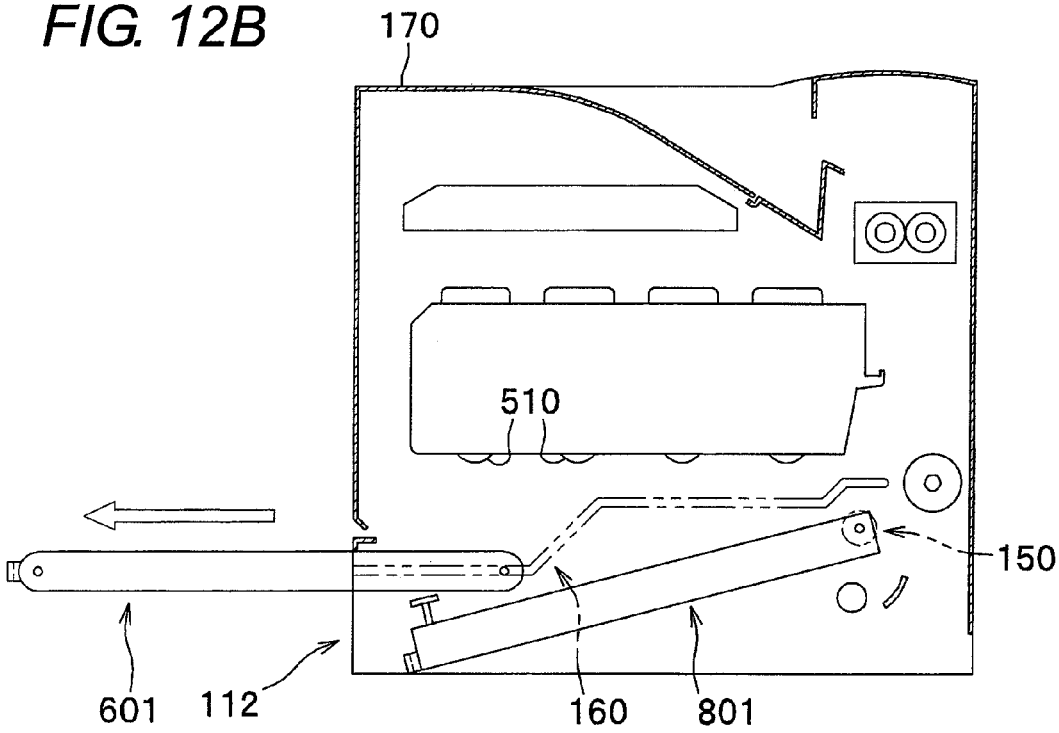
FIG. 12B shows a diagram showing an operation for detaching the intermediate transfer belt unit from the main body.

In this modification, after the sheet feed tray 201 is detached from the main body 170 as shown in FIG. 11B, by pivoting downward the manual-feed conveying path unit 801 as shown in FIG. 12A, an upper surface of the intermediate transfer belt unit 601 faces the pull-out port 112. In this state, the maintenance, such as fixing the paper jam, can be performed. Further, from this state, as shown FIG. 12B, by detaching the intermediate transfer belt unit 601 from the pull-out port 112, an exchange of the intermediate transfer belt unit 601 and a fixing of the paper jam in the manual-feed conveying path unit 801 can be performed.

In the exemplary embodiment, the belt unit can be completely separated (detached) from the main body. However, the present invention is not limited thereto, and the belt unit may simply movable so as to incline. Even in this case, it is possible to fix the paper jam between the belt unit and the photosensitive drums.

In the exemplary embodiment, the sheet feed tray detachably attached to the main body is exemplified as the sheet storing unit. However, the present invention is not limited thereto, and a sheet storing portion as a part of the main body and undetectable from the main body may be provided. Even in this case, when the recording sheet is removed from the sheet storing unit, the maintenance work can be performed by retracting the belt unit into a space formed by removing the recording sheet.

In the exemplary embodiment, the mechanism configured to retract the conveying path unit while the conveying path unit rotates is adopted as the retracting mechanism. However, the present invention is not limited thereto. For example, a mechanism configured to slide the conveying path unit downward may be adopted as the retracting mechanism.

In the exemplary embodiment, the mechanism configured to indirectly hold the belt unit via the conveying path unit (i.e., the lock mechanism 910 and the support arm 920) is exemplified as the holding mechanism. However, the present invention is not limited thereto. For example, a lock mechanism configured to directly hold the belt unit may be adopted as the holding mechanism.

In the exemplary embodiment, the lock mechanism 910 including the hook 911 is adopted. However, the present invention is not limited thereto. For example, the lock mechanism may include: a pin configured to move to and away from the conveying path unit; and a hole which is formed at the conveying path unit and in which the pin is fit.

In the exemplary embodiment, the side frame 114 having the guide groove 160 is exemplified as the guide member, but the present invention is not limited thereto. For example, a guide rail having a rib shaped fixed to an inner surface of the side frame may be adopted as the guide member. Further, instead of supporting the pivot axis of the belt unit as in the exemplary embodiment, the guide member may support a portion other than the pivot axis of the belt unit and guide the belt unit.

The drawer 520 may be detachable so as to be completely separate from the main body 110. Instead, a part of the drawer 8 may be supported and engaged with the main body 10 when the drawer 8 is pulled out, in other words, the drawer 8 may not completely detached (separated) from the main body 10. Even when the drawer 520 can not be completely separated from the main body 110, the present invention can especially be effective.

In the first and second exemplary embodiments, the color printer 1 or 100 is exemplified as the image forming apparatus. However, the present invention is not limited thereto, and any other type of the image forming apparatus, e.g., a copier or a multifunction device may be adopted.

Further, in the first and second exemplary embodiments, as an example of the recording sheet P, a heavy paper, a post cart, or thin paper is adopted. However, the present invention is not limited thereto, and the recording sheet may be, e.g., an OHP sheet.

In the first and second exemplary embodiments, as the image forming unit, the process cartridge 5 or 500 including the photosensitive drum 51 or 510 is exemplified. However, the present invention is not limited thereto, and the image forming unit may, e.g., include a belt-shaped photosensitive body.

What is claimed is:

1. An image forming apparatus comprising:

a main body;

an image forming unit comprising a plurality of photosensitive drums on which electrostatic latent images are formed, respectively;

a sheet storing unit detachably attached to the main body and configured to store a recording sheet, and the sheet storing unit being disposed in a first space defined in the main body when the sheet storing unit is attached to the main body;

a belt unit disposed between the plurality of photosensitive drums and the sheet storing unit and comprising a belt opposing the plurality of photosensitive drums; and a guide member configured to guide the belt unit between a horizontal position and an inclined position in the first space, wherein the belt unit is detachable from the main body through the first space in a state in which at least a part of the sheet storing unit is positioned at an outside of the main body.

2. The image forming apparatus according to claim 1, wherein the guide member is configured to guide the belt unit between a position at which the belt unit contacts the plurality of photosensitive drums and a position at which the belt unit is separated from the plurality of photosensitive drums and enters the first space.

3. The image forming apparatus according to claim 2, further comprising a guide rail configured to guide the belt unit to the outside of the main body in a state in which the belt unit is separated from the plurality of photosensitive drums.

4. The image forming apparatus according to claim 3, wherein the plurality of photosensitive drums, the belt unit and the sheet storing unit are arranged in this order from an upper side to a lower side, wherein said image forming apparatus further comprises a support member which supports the belt unit from below and which positions the belt unit in a up-down direction, and wherein the belt unit is separated from the plurality of photosensitive drums by moving the support member so as to release a support to the belt unit.

5. The image forming apparatus according to claim 4, wherein the support member is movable among a plurality of positions including a first position and a second position arranged in a horizontal direction, wherein the support member comprises:

a support surface which supports a part of the belt unit when the support member is positioned at the first position; and an escape groove provided adjacent to one end of the support surface and has a concave shape so as to increase a distance between a surface of the escape groove and the belt unit, and wherein in a state in which the support member is positioned at the second position, when a part of the belt unit enters the escape groove, the belt unit is separated from the plurality of photosensitive drums, which allows the belt unit to be pulled out together with the support member.

6. The image forming apparatus according to claim 5, wherein the escape groove comprises: an inclined surface connected to the one end of the support surface; and a bottom surface, and wherein the inclined surface inclines toward the bottom surface as a distance from the support surface increases.

7. The image forming apparatus according to claim 1, further comprising a supply unit which is configured to supply the recording sheet stored in the sheet storing unit to the belt unit and which is overlapped with the belt unit as viewed from a direction in which the recording sheet is conveyed by the belt.

8. The image forming apparatus according to claim 1, further comprising a fixing device which is configured to thermally fix a toner image transferred to the recording sheet and which is overlapped with the belt unit as viewed from a direction in which the recording sheet is conveyed by the belt.

9. The image forming apparatus according to claim 1, further comprising a holding member which holds the plurality of photosensitive drums and which is capable of being pulled out toward an outside of the main body.

10. The image forming apparatus according to claim 9, wherein the holding member has a configuration so as not to be separated from the main body even in a state in which the holding member is pulled out.

11. The image forming apparatus according to claim 1, further comprising:

a conveying path unit which is disposed in a second space defined on an opposite side of the image forming unit across the belt unit and above the sheet storing unit in the main body and which is configured to convey the recording sheet along a belt surface of the belt;

a retracting mechanism configured to retract the conveying path unit to the first space; and a holding mechanism configured to hold the belt unit such that the belt unit is detachable from the main body, wherein the belt unit is capable of being displaced to the first space through the second space.

12. The image forming apparatus according to claim 11, wherein the sheet storing unit is slidable so as to be attached to and detached from the main body.

13. The image forming apparatus according to claim 11, wherein the conveying path unit comprises a support portion which supports the belt unit.

14. The image forming apparatus according to claim 13, wherein the holding mechanism comprises a lock mechanism configured to hold the conveying path unit to the main body so as to hold the belt unit via the conveying path unit.

15. The image forming apparatus according to claim 11, wherein the main body has an opening portion so as to connect the first space and the outside of the main body, and wherein the conveying path unit is pivotably supported to the main body, such that a pivot axis is located at one end portion of the conveying path unit and a pivot end is located at the other end portion of the conveying path unit which is closer to the opening portion than the one end portion of the conveying path unit.

16. The image forming apparatus according to claim 15, wherein the belt unit is pivotably supported to the main body, such that a pivot axis is located at one end portion of the belt unit and a pivot end is located at the other end portion of the belt unit which is closer to the opening portion than the one end portion of the belt unit.

17. The image forming apparatus according to claim 16, wherein the belt unit is detachably attached to the main body through the opening portion, and wherein the main body comprises the guide member configured to guide the belt unit between the inside of the main body and the outside of the main body.

18. The image forming apparatus according to claim 17, wherein the guide member is configured to guide the belt unit while supporting a portion of the belt unit corresponding to the pivot axis of the belt unit.

19. The image forming apparatus according to claim 11, wherein the belt unit is a sheet conveying belt unit configured to convey the recording sheet placed on a surface of the belt closer to the image forming unit, and wherein the conveying path unit is a duplex conveying path unit configured to convey the recording sheet, which has passed between the image forming unit in a state in which a first side thereof faces the image forming unit, to the belt unit so as to allow a second side of the recording sheet opposite to the first side to face the image forming unit.

20. The image forming apparatus according to claim 11, wherein the belt unit is an intermediate transfer belt unit on which an image is formed by the image forming unit, and wherein the conveying path unit is a manual-feed conveying path unit configured to convey the recording sheet which is manually fed.

* * * * *